United States Patent [19]

Brooks

[11] 4,135,568

[45] Jan. 23, 1979

[54] SHIELD FOR ELECTROMAGNETIC CONTINUOUS CASTING SYSTEM

[75] Inventor: Carson L. Brooks, Richmond, Va.

[73] Assignee: Reynolds Metals Company, Richmond, Va.

[21] Appl. No.: 851,704

[22] Filed: Nov. 15, 1977

[51] Int. Cl.[2] ..... B22D 11/01; B22D 27/02

[52] U.S. Cl. ..... 164/147; 174/35 CE

[58] Field of Search ..... 164/49, 147; 174/35 CE

[56] References Cited

U.S. PATENT DOCUMENTS

| | | | |
|---|---|---|---|
| 3,020,329 | 2/1962 | Deans | 174/35 CE X |
| 3,605,865 | 9/1971 | Getselev | 164/147 X |
| 3,655,907 | 4/1972 | Philibert et al. | 174/35 CE X |

*Primary Examiner*—Robert D. Baldwin

*Attorney, Agent, or Firm*—Glenn, Lyne, Girard, Clark and McDonald

[57] ABSTRACT

A shield to be used in an electromagnetic continuous casting system comprises segmental strips forming a segmented, tubularly-shaped shield encircling a casting station and being positioned between molten metal being cast and an electromagnetic inductor.

12 Claims, 7 Drawing Figures

FIG. 1
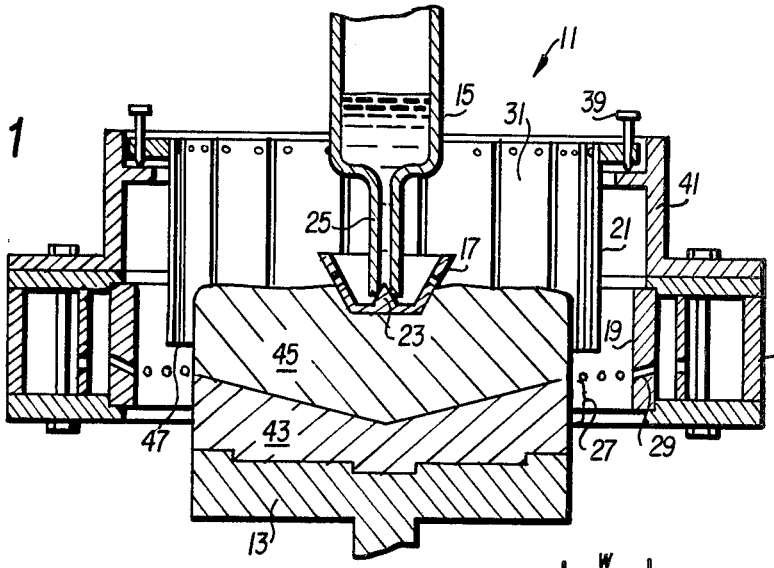
FIG. 3A
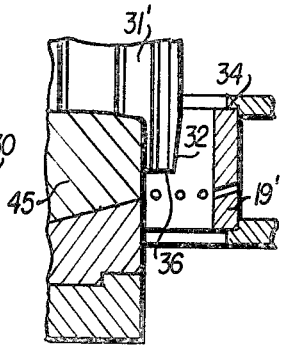
FIG. 2
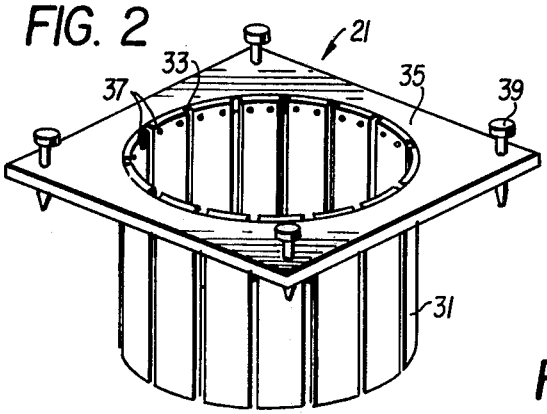
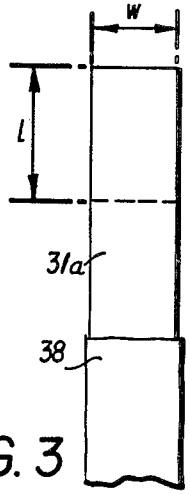
FIG. 3
FIG. 4
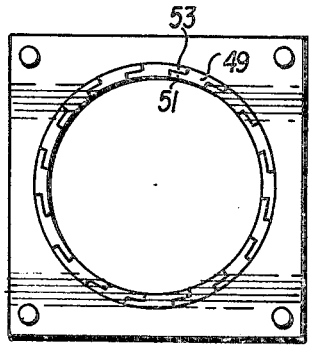
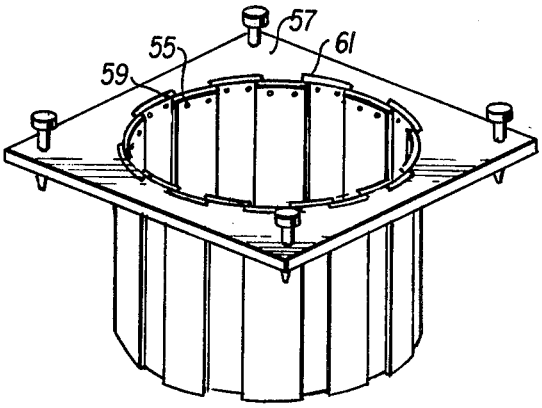
FIG. 5
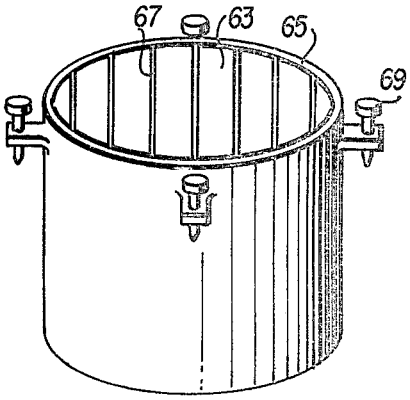
FIG. 6

SHIELD FOR ELECTROMAGNETIC CONTINUOUS CASTING SYSTEM

BACKGROUND OF THE INVENTION

This invention relates broadly to the art of continuous and semicontinuous metal casting systems, and more particularly, to such systems wherein electromagnetic inductors serve to shape molten metal prior to solidification thereof.

Prior-art patents disclosing electromagnetic casting systems of the type to which this invention relates include U.S. Pat. Nos. 3,467,166 to Getselev et al., 3,605,865, 3,702,155 and 3,773,101 to Getselev, 3,735,799 to Karlson, and 3,985,179 and 4,004,631 to Goodrich et al.

These prior-art patents describe a system for continuously and semicontinuously electromagnetically casting wherein molten metal is first introduced at a controlled rate into a bottom block, or pan, located within a loop-shaped inductor to form an embryo ingot. The bottom block is then lowered at a controlled rate with metal flow being controlled in accordance with this rate to form an ingot. The molten metal so introduced is confined laterally by electromagnetic forces generated by an alternating current in the inductor. The molten metal is thus formed into a shape in a horizontal plane similar to, but smaller than, the inductor. The emerging ingot is solidified in this shape by the application of a coolant such as water.

In most of these systems there is a tapered electromagnetic shield, or screen, located inside the inductor arranged coaxially therewith made of a non-magnetic, but electrically conductive, metal. The shield serves to attentuate the magnetic field of the inductor upwardly, thereby lessening the electromagnetic forces restraining the ingot at the top as opposed to those at the lower edge of the shield. The advantages of such a shield are fully described in U.S. Pat. No. 3,605,865 to Getselev, and the information in that patent is incorporated by reference herein. In practice, it has been found that these loop-shaped shields have warped very quickly. This warping is due to the large amount of energy that the shields have to absorb. Such distortion of the shields not only changes the magnetic fields, and thereby changes the shapes of the outer surfaces of shaped ingots, but also sometimes changes the point of coolant impingement on ingots, because coolant drops onto the ingots from the lower tips of the shields.

Thus, it is an object of this invention to provide a shield for electromagnetic continuous casting which does not warp as easily as prior art shields.

Another difficulty with prior-art shields is that they normally must be cooled to dissipate the large amounts of energy they absorb from the heat of the molten metal and from the electromagnetic fields. This cooling of the shields causes problems in that water falling from the lower tips of the shields contacts the ingots in a nonuniform manner, even when the shields are not warped as is described above. It is possible to design systems in which water falls from the lower tips of the shields without hitting the ingots, but even in these cases, this water interferes with water from separate spray units which spray onto the ingots.

Thus, it is another object of this invention to provide a shield for an elecromagnetic continuous casting system which must not be cooled.

It is a further object of this invention to provide a shield for an electromagnetic casting system which provides protection for personnel and equipment (including the inductor) surrounding an electromagnetic casting station.

It is another object of this invention to provide a shield for an electromagnetic casting system which can be easily repaired upon the warping thereof or upon contacting molten metal in an ingot.

SUMMARY

According to principles of this invention, a shield comprises segments of an electrically conductive, but non-magnetic, metal which are insulated from one another. The segments are mounted on an insulative body so as to form a tubular shape around an ingot at a casting station between the ingot and an electromagnetic inductor.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a cross-sectional view of an electromagnetic casting system having a shield employing principles of this invention;

FIG. 2 is an isometric view of the shield of FIG. 1;

FIG. 3 is an elevational view of a sheet of stainless steel from which the segments of the shield of FIGS. 1 and 2 are cut;

FIG. 3A is a fragmented, sectional view of shield segments in a modified embodiment;

FIG. 4 is a top view of a second embodiment shield employing principles of this invention;

FIG. 5 is an isometric view of a third embodiment shield employing principles of this invention; and FIG. 6 is an isometric view of a fourth embodiment shield employing principles of the invention.

DESCRIPTION OF THE PREFERRED EMBODIMENT

Referring to FIG. 1, an electromagnetic continuous casting apparatus 11 comprises a movable bottom block or pan 13, a supply spout 15 controlled by a float 17, a solid inductor 19, and an electromagnetic shield 21. In overall operation, molten metal flows from the supply spout 15 via the float onto the bottom block or pan 13. The float 17 has a cone shaped valve portion 23 positioned in a nozzle 25 of the supply spout 15 to regulate the amount of molten metal fed onto the pan 11.

The molten metal is maintained in an appropriately shaped column by the electromagnetic and electrostatic forces created by alternating current in the solid inductor 19. The manner in which this is achieved is described in the above-mentioned prior-art patents, and will therefore not be described in greater detail here.

Coolant, such as water, is sprayed onto the molten metal at an impingement zone 27 and this can be accomplished, as is shown in the prior art, by spraying through passages 29 in the solid inductor 19. In this respect, the solid inductor 19 forms a wall of a coolant box 30 which is supplied with a coolant (supply apparatus not shown)

so as to provide a "water-through-inductor" coolant system.

This invention concerns primarily the shield 21 which is shown in more detail in FIG. 2. Corresponding prior art shields form solid loops and thereby serve as a secondary of a transformer whose primary is the solid inductor 19. Because the prior-art shields are completely closed single turns, their coupling with inductors creates circulating currents in the shields causing heating which in the case of stainless steel (which is normally used for shields) is normally kept under control by water cooling. However, the shield of FIGS. 1 and 2 does not form a closed single turn. In this regard, the shield 21 is comprised of stainless steel segments 31 which are each attached to an edge forming a hole 33 in a one-inch thick micarta square 35 by two sheet metal screws 37.

In the FIG. 1 embodiment, the stainless steel segments 31 are cut from a 0.010 inch thick stainless strip 31*a* (FIG. 3) which has a width "w" of four inches, and their ends are not tapered.

In the FIG. 3A embodiment, however, stainless steel segments 31' are ¼ inch thick, being made from ¼" plate. In this embodiment, lower ends of the segments 31' are tapered as with the shields of most prior-art electromagnetic casting systems (see U.S. Pat. No. 3,605,865 to Getselev). Basically the tapered ends attenuate field forces to match the hydrostatic forces being exerted by the molten head 45. Tapers 32 are at 15° with the vertical, extending inwardly from approximately the top 34 of the solid inductor 19' to a feather edge 36 at the approximate center line of the inductor 19'. The rest of the shield segments 31' are for mechanical strength and rigidity. Again, the thin shield of FIG. 1 must not necessarily be tapered. In the FIG. 3A embodiment the width "w" of the stainless steel segments 31' can be narrower than the thin segments of FIG. 1, such as less than 1 inch. Other than comments related to the thicknesses and the tapered lower ends of the shields the other comments made herein apply to both the FIGS. 1 and 3A embodiments.

Each of the segments 31 and 31' in the illustrated embodiments, has a length "1" of approximately 6 inches. The stainless steel segments 31 and 31' are mounted to be electrically insulated from one another. In this respect, it can be seen in FIG. 2 that they are spaced from one another, however, this spacing is exaggerated in FIGS. 1 and 2 for purposes of illustration. Further, an insulation such as silicone cement 38, is coated onto the segments 31 and 31' to provide an insulating barrier between the segments. The hole 33 is the micarta square 35 has a diameter that is the desired size of the outside of the shield.

It can be seen in FIG. 1 that the corners of the micarta square 35 are tapped for jack screws 39 to be used in mounting and positioning the shield 21 vertically inside the inductor 19. In this regard, the jack screws 39 rest on fixed supports 41 of the electromagnetic continuous casting apparatus 11 and can be rotated to move the shield 21 upwardly and downwardly.

In operation, the shield 21 is positioned between an ingot 43 (having a molten head 45) and the solid inductor 19. The lower tip 47 of the shield is normally positioned about halfway between the top and bottom of the solid inductor 19. An AC current is applied to the inductor 19 to create an electromagnetic field which holds the molten head 45 in an appropriate shape until it is solidified by coolant sprayed onto the ingot from the passages 29. Fresh molten metal is supplied to the top of the molten head 45 by the float 17 as the pan 13 moves downwardly.

It should be noted that no coolant is sprayed onto the shield 21. Since the shield 21 does not form a closed loop, it does not absorb sufficient energy that it heats up to the extent that it must be cooled. In this respect, tests have indicated that if 11 Kilowatts are fed into the inductor 19 a segmented shield absorbs only one kilowatt of energy as opposed to approximately 5 kilowatts of energy absorbed by a normal shield under similar conditions. Notwithstanding this, however, the shield does operate to appropriately modify the electromagnetic field to properly shape molten metal for casting ingots. Tests conducted with such a segmented shield have produced satisfactory ingots.

In addition, such a segmented shield 21 can be easily repaired by replacing appropriate segments that have become warped or damaged.

The embodiments of FIGS. 4, 5, and 6 are similar to the FIGS. 1 and 2 embodiments but are designed to produce a more uniform attenuation of the electromagnetic field than the FIGS. 1 and 2 embodiment. In this respect, in the FIG. 4 embodiment, shield segments 49 have tongues 51 which overlap with corresponding tongues 53 of adjacent segments. The tongue portions 51 and 53 are half the thickness of the other portions of the segments 49. Thus, the composite thickness of the tongues 51 and 53 at the joints of the segments 49 is approximately the same as the thickness of the other portions of the shield segments 49. Again, the segments 49, especially the joints thereof, are coated with an insulation, such as silicon cement, to prevent electrical continuity between the segments 49. It will be appreciated that such a shield will have a more uniform effect on an electromagnetic field than the shield of FIGS. 1 and 2 which includes spaces between shield segments 31.

In the shield of FIG. 5, a hole 55 in a micarta square 57 has uniformly positioned radial protrusions 59 about the circumference thereof. Segments 61 are alternately mounted on the protrusions 59 and troughs 61 of the hole 55. The segments 61 are of such a size to overlap one another circumferentially so as not to leave spaces between them through which an electromagnetic field can pass unattenuated.

In the FIG. 6 embodiment, segments 63 are adhered to an interior surface of a tubularly-shaped resinous mounting member 65. The segments 63 have spaces 67 between them. The segments 63 can be coated onto the interior surface of the resinous mounting member 65 using a variety of different methods, such as to ion deposit, vapor deposit, etc. The segments could also be glued to the mounting member 65. Jack screws 69 are used to mount the FIG. 6 shield in the same manner as the jack screws 39 are used in the FIGS. 1 and 2 shield.

The operations of the shields of FIGS. 4–6 are the same as the operation of the shield of FIGS. 1 and 2. It will be appreciated that the teachings of the FIGS. 4–6 embodiments can be applied to thin shield segments of the FIG. 1 embodiment and to the thicker shield segments of the FIG. 3A embodiment.

It will also be appreciated by those skilled in the art that the shields depicted and described herein will not absorb as much energy as prior-art shields and will be easy to repair upon damage to segments thereof.

While the invention has been particularly shown and described with reference to a preferred embodiment, it will be understood by those skilled in the art that various changes in form and detail may be made therein without departing from the spirit and scope of the invention.

I claim:

1. A shield to be used in an electromagnetic continuous casting system of the type including a loop-shaped electromagnetic-inductor positioned about a casting station for shaping molten metal at said casting station as said molten metal is cooled, said shield comprising:

an electrically insulative body including a mounting means for mounting said electrically insulative body at said casting station;

a plurality of metallic segments attached to said insulative body, but electrically insulated from one another, said metallic segments being arranged to generally form a segmented, tubularly-shaped shield made up of said metallic segments, said segmented shield encircling said casing station to be positioned between said molten metal and said electromagnetic inductor when said continuous casting system is casting;

said insulative body including a single flat sheet of insulative material having a hole therein and wherein said metallic segments are attached at one end portion only of each of said segments to the interior surface of said hole in said insulative body to depend laterally away from said flat insulative body and to form said tubular shape having a cross sectional area which is the shape of said hole.

2. A shield as in claim 1 wherein said metallic segments are spaced from one another about said hole.

3. A shield as in claim 1 wherein said metallic segments overlap one another at edges thereof.

4. A shield as in claim 1 wherein said metallic segments are approximately 0.010 inches thick and do not have tapered ends.

5. A shield as in claim 1 wherein said metallic segments are approximately ¼ inch thick and have tapered ends.

6. Apparatus for continuously casting an elongated ingot comprising:

a molten-metal supply means for continuously supplying molten metal to a first end of said ingot at a casting station;

a means for moving a second end of said ingot away from said supply means;

an electromagnetic inductor positioned at said casting station for producing an electromagnetic field in said molten metal to generate forces in said molten metal; and a shield having a portion thereof mounted between said electromagnetic inductor and said ingot, said shield comprising:

an electrically insulative body including a mounting means for mounting said electrically insulative body at said casting station;

a plurality of metallic segments attached to said insulative body, but electrically insulated from one another, said metallic segments being arranged to generally form a segmented, tubularly-shaped shield made up of said metallic segments, said segmented shield encircling said molten metal, and being positioned between said molten metal and said electromagnetic inductor.

7. An apparatus as in claim 6 wherein said insulative body includes a single flat sheet of insulative material having a hole therein and wherein said metallic segments are attached at one end portion only of each of said segments to the interior surface of said hole in said insulative body to depend laterally away from said insulative body and to form said tubular shape having a cross sectional area which is the same as the shape of said hole.

8. An apparatus as in claim 7 wherein said metallic segments are spaced from one another about said hole.

9. An apparatus as in claim 7 wherein said metallic segments overlap one another at edges thereof.

10. An apparatus as in claim 6 wherein said metallic segments are approximately 0.010 inches thick.

11. An apparatus as in claim 10 wherein said metallic segments do not have tapered ends.

12. An apparatus as in claim 6 wherein said segments are approximately ¼ inch thick and have tapered ends.

* * * * *